US008245618B2

(12) United States Patent
Emde

(10) Patent No.: US 8,245,618 B2
(45) Date of Patent: Aug. 21, 2012

(54) BARREL JACKET FOR A FIREARM

(75) Inventor: Dietmar Emde, Arnsberg-Voswinkel (DE)

(73) Assignee: German Sport Guns GmbH, Ense-Hoingen (DE)

( * ) Notice: Subject to any disclaimer, the term of this patent is extended or adjusted under 35 U.S.C. 154(b) by 258 days.

(21) Appl. No.: 12/646,210

(22) Filed: Dec. 23, 2009

(65) Prior Publication Data

US 2011/0146130 A1 Jun. 23, 2011

(51) Int. Cl.
*F41A 35/02* (2006.01)

(52) U.S. Cl. ..... 89/14.1; 42/96

(58) Field of Classification Search ..... 89/14.1; 165/177–184; 42/96
See application file for complete search history.

(56) References Cited

U.S. PATENT DOCUMENTS

| | | | | |
|---|---|---|---|---|
| 2,478,950 | A * | 8/1949 | Spurling | 89/14.1 |
| 2,935,912 | A * | 5/1960 | Hartley | 89/14.1 |
| 2,965,994 | A * | 12/1960 | Sullivan | 42/71.01 |
| 5,062,346 | A * | 11/1991 | Greve Hansen et al. | 89/14.1 |
| 7,997,020 | B2 * | 8/2011 | Brixius | 42/90 |
| 2004/0144245 | A1 | 7/2004 | Wonisch et al. | |
| 2005/0262997 | A1 * | 12/2005 | Brixius | 89/14.1 |
| 2010/0224053 | A1 * | 9/2010 | Brixius | 89/14.1 |
| 2011/0100204 | A1 * | 5/2011 | Schlenkert et al. | 89/14.1 |

* cited by examiner

*Primary Examiner* — Michael David
(74) *Attorney, Agent, or Firm* — Mannava & Kang, P.C.

(57) ABSTRACT

A barrel jacket covering at least partially the outer surface of the bullet-guiding barrel of a firearm is provided, wherein the barrel jacket has at least one inner casing and one outer casing and a spacer. The inner casing is arranged adjacent to the barrel, covering the barrel in a close-up position. The outer casing is arranged at a distance to the inner casing, covering the inner casing, thus providing a continuous gap. The continuous gap is stabilized by at least one spacer, which stabilizes the inner casing and outer casing in their relative positions.

11 Claims, 3 Drawing Sheets

BARREL JACKET FOR A FIREARM

Figure 1:
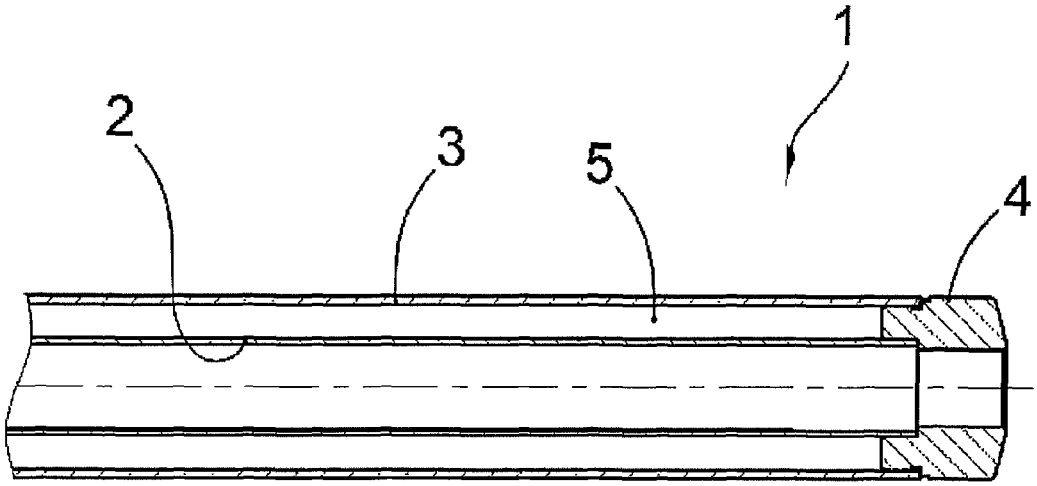

The present invention concerns an improved barrel jacket of a firearm, said barrel jacket covering at least partially the outer surface of the bullet-guiding barrel of said firearm.

TECHNICAL AREA

The technical area of the present invention is the area of firearms. Firearms are manually operated projectile weapons, which propel a projectile via a projectile-guiding barrel at a target. Such weapons comprise small caliber pistols, semi- and fully automatic guns, pistols and rifles.

DESCRIPTION OF PRIOR ART

A barrel jacket is known from small caliber pistols, the like of which are described in US2004/0144245. Said document concerns a small caliber pistol, wherein a barrel block is securely joined to a barrel tube, e.g. by brazing. The barrel jacket is tube-shaped and can be slipped form-fittingly onto a nozzle-section of the barrel-tube, resulting in part of the barrel-tube having a tubular barrel jacket attached in direct, surfacial contact. A barrel-nut has to be fastened onto the nozzle of the barrel-tube, in order to secure the slipped-on barrel jacket in its position. Thus, the barrel jacket covers part of the barrel tube in direct, surfacial contact, and is locked in position at its edges by the barrel-nut on one side and the barrel block on the other side.

The barrel jacket according to the prior art is therefore fixed at its edges, while form-fittingly covering the barrel in surfacial contact. The projectile-guiding barrel of the firearm is thus covered by the barrel jacket partially along its outer surface.

Barrel jackets known from the prior art are disadvantageous, because barrel and barrel jacket are required to dissipate heat during use very evenly, in order to prevent warping of the weapon due to mismatching, thermal expansion of its parts during heat-up. This necessitates the use of expensive materials, which are precisely adjusted in their thermal conductivities and thermal expansion coefficients. Furthermore the weapon's surface quickly becomes hot, impairing its use additionally.

One object of the invention is to provide a barrel jacket, which will avoid the disadvantage of expensive, precisely controlled materials and allows an economically advantageous production.

A further object of the invention is to provide a barrel jacket, that avoids encumbering heat-up and improves usability.

The solution to the object of the invention can be achieved according to the independent claims. Further advantageous features and embodiments are given in the dependent claims as well as the following explanation of dependent, advantageous features and description of preferred embodiments.

SUMMARY OF THE INVENTION AND FURTHER ADVANTAGEOUS FEATURES

An improved barrel jacket of a firearm according to the present invention is characterised by said barrel jacket (1) covering at least partially the outer surface of the bullet-guiding barrel of said firearm, wherein said barrel jacket (1) has at least one inner casing (2) and one outer casing (3) and a spacer (4), wherein furthermore the inner casing (2) is arranged adjacent to the barrel, covering said barrel in a close-up position, the outer casing (3) is arranged at a distance to the inner casing (2), covering said inner casing (2), thus providing a continuous gap (5) between inner casing (2) and outer casing (3), said continuous gap (5) being stabilised by at least one spacer (4), said spacer (4) stabilising inner casing (2) and outer casing (3) in their relative positions.

A 'casing' designates a component, which covers the barrel along its outer surface. Preferably a casing embracing the nozzle has at least one circular aperture to allow the exit of the projectile. More preferably a nozzle-embracing casing has a large standard aperture that allows the exit of all common calibers of bullets, making the casing compatible to different types of barrels and thus reducing costs by avoiding specially adapted casings. The latter feature is especially advantageous in combination with a barrel jacket (1), which covers the barrel completely along its outer, visible surface. The optical size of the barrel can thus be kept constant and the visible opening in the muzzle-area will provide no clue to the actually used caliber of ammunition as well as type and length of barrel. Thus the optical appearance is no longer a give-away of the type of weapon, leaving a potential foe unsure about range and firepower of said weapon. Thus the present invention additionally provides a preferable camouflage-function, increasing the potency of intimidation considerably in combination with modular, customizable firearm-systems.

The arrangement of the inner casing (2) adjacent to the barrel in a covering position leaves the barrel without detrimental strain during use; such can be achieved for example by said inner casing (2) being produced from a much more elastic material or from an inexpensive alloy, which has a larger thermal expansion coefficient. Preferably the adjacent arrangement is characterised by a close distance, that allows thermal expansion of the barrel while still keeping inner casing (2) and barrel free of additional strain.

Said preferable close distance is preferably at least as large as the maximum thermal expansion of the barrel to ensure close distance even in case of continuous use, more preferably not exceeding 1 millimeter thus keeping the risk of rattling or clanking low. Most preferably said close up position is characterised by a submillimeter gap extending continuously along the covered barrel-surface. Such a type of gap advantageously avoids jamming of weapon parts during assembly, wherein said inner casing is slipped onto the barrel of the firearm.

An outer casing 3 is arranged around the inner casing 2, embracing said inner casing 2 entirely. The outer casing 3 has a larger diameter than the inner casing 2, preferably of 2 millimeters to 10 cm larger, most preferably a diameter within the range of 1 centimeter to 8 centimeters, the latter range allowing the outer casing to be cost-effectively applied to all conventional types of firearm-barrels. The outer casing 3 is arranged at a distance to the inner casing 2, providing a continuous gap 5.

Preferably said continuous gap 5 has a continuous thickness of at least one millimeter, preferably 2 millimeters to 3 cm, most preferably 0.5 cm to 1.5 cm. The continuous gap 5 is stabilised by at least one spacer 4. Thus the continuous gap 5 separates thermally the inner casing 2 and the outer casing 3, providing a thermal barrier.

A spacer 4 ensures a permanent distance between inner casing 2 and outer casing 3 by stabilising their relative positions. By arranging said spacer 4 in areas of low heat-production and/or producing said spacer from materials of decreased thermal conductivity, the thermal barrier provided by the continuous gap is advantageously maintained along the relevant surface-areas of the inner casing. Preferably said spacer is arranged elastically in mutual contact between inner casing 2 and outer casing 3, providing by its own, increased elasticity an improved dampening-function, that will advantageously reduce vibrations and related noise. Most preferably said spacer 4 consists at least partially out of an elastomer, providing advantageously a direct contact between said elastomer and the casings and stabilising the relative positions of said casings by elastic compression of its elastic parts.

The combination of close-up position of inner casing 2, distanced position of outer casing 3 and stabilisation of the continuous gap 5 via at least one spacer 4 ensures a tolerable outer temperature of the outer casing 3 while allowing at the same time the use of less complicated materials and more economic materials.

The advantageous details of one or more implementations according to dependent claims of the invention are set forth in the description below. Other features, objects, and advantages of the invention will be also apparent from the description and advantageous embodiments.

Advantageously a barrel jacket according to the present invention has an outer casing (3), which is provided as a continuous, hollow body, enclosing the inner casing (2) completely along its outer surface. The complete enclosure protects the inner casing from considerable, direct wear, as would be aggravated in the case of incident sun-light, contact with corrosive rain, water, liquid or abrasive particles.

Advantageously a barrel jacket according to the present invention has a spacer 4 shaped as a terminating means, sealing the continuous gap 5 against dust, preferably providing a continuous gap 5 of confined volume. Said dust-proof, confined volume provides additional advantageous protection against particulate, abrasive wear, that would occur in the case of ambient air carrying ceramic or mineral dust, e.g. in a desert or in high mountain areas.

Advantageously a barrel jacket according to the present invention has an inner casing 2 and an outer casing 3 in a concentrical arrangement. A concentrical arrangement is characterised by inner casing 2 and outer casing 3 having similar outer shape and being arranged with coincident centers of geometry. Said centers of geometry are arranged along the axis of the barrel of the firearm, resulting in an even thickness of said continuous gap 5 in cross-cut perspective. Such an arrangement will ensure even thickness of said gap 5, even if the parallel of the gun and the casings are twisted in relation to each other, e.g. during assembly. Heat generated during use will be compensated evenly and radially in all directions within the continuous gap 5.

Advantageously a barrel jacket according to the present invention has a nozzle terminating cap 41. During use hot compressed gas will propel the projectile out of the barrel and gas and projectile will exit the barrel via the nozzle. Thus, the area around the nozzle is prone to a locally increased amount of heat. The nozzle terminating cap is arranged in this area and will compensate the increased thermal load, delimiting securely the continuous gap 5. Preferably the nozzle terminating cap will be shaped so as to function simultaneously as an advantageous spacer 4. By arranging the nozzle terminating cap 41 as a spacer 4 on the barrel in mutual contact with inner casing 2 and outer casing 3—said contact preferably being a mutual force-locking contact, most preferably being a form-fitting contact via threaded ends—, the relative positions of barrel, inner casing 2 and outer casing 3 are stabilised simultaneously while also providing a shield against the increased thermal load of the nozzle-area.

Advantageously a barrel jacket according to the present invention has a rear-terminating cap 42. Especially in the area of semi-automatic firearms of compact construction the barrel is normally integrated directly into the main frame of the weapon and will transfer heat directly onto all attached parts. A rear-terminating cap allows to integrate the barrel jacket into the main frame while ensuring at the same time an improved thermal delimitation. Thus a compact, space-saving attachment can be provided with the rear-terminating cap 41—e.g. via a mechanical catch or outer latching mechanism, preferably via a threaded end interacting with a standard mounting thread within the weapon main frame.

Preferably the rear-terminating cap will be shaped so as to function simultaneously as an advantageous spacer 4. By arranging the rear-terminating cap 42 as a spacer 4 on the barrel in a close-up-position or even in mutual contact with inner casing 2, outer casing 3 and weapon main frame—said contact preferably a mutual force-locking contact, most preferably a form-fitting contact via threaded ends—, the relative positions of barrel, inner casing 2, outer casing 3 and weapon main frame are stabilised simultaneously while also providing a shield against thermal load of the weapon main frame.

Preferably a barrel jacket having terminating caps allows modular assembly of a barrel jacket with a continuous sequence of casings, enabling the barrel jacket to be adapted in its length to barrels of differing length, allowing in especially advantageous application to completely camouflage the actual length of the barrel, in order to avoid any optical give-away of weapon specifics.

Advantageously a barrel jacket according to the present invention is attachable to a firearm via a cocking tube guide 6. A cocking tube guide is a guide attached firmly to the weapon main frame. It guides slideably a tube, which is in interaction with the cocking mechanism of the firearm, allowing the easy and quick cocking of the weapon via a protruding lever of said tube. By attaching the barrel jacket 1 to the cocking tube guide 6, a force-transducing connection to the weapon main frame is provided, that will compensate most of inflicted, lateral forces in the case of rough handling of the weapon via its barrel jacket 1. Thus attaching the barrel jacket 1 via a cocking tube guide 6 to the weapon main frame decreases the lateral forces exerted onto the barrel, making a distortion or deviation of the barrel less probable and improving the performance of the weapon in rough conditions.

Advantageously a barrel jacket of the present invention has at least one spacer 4, said spacer 4 having an inner diameter and an outer diameter, the inner diameter being smaller than the outer diameter of the inner casing 2, and said spacer 4 having furthermore a continuous ring surface, said ring surface being arranged in slideable support or close-up position on the barrel of the firearm. While advantageously stabilising the relative positions of barrel and casings, such a spacer also acts as a stabiliser toward the barrel and an improved seal, protecting the close-distance gap between barrel and inner casing against ambient pollution and corrosion via its continuously enclosing ring-surface. Preferably such a ring-surface consists out of a thermally resilient, elastic polymer, that is compatible with common high-temperature weapon oils in order to ensure a reliably slideable, tight attachment, which is easy to clean and service, especially preferred a chemically and thermally resistive silicone-polymer.

Advantageously a barrel jacket according to the present invention has at least one spacer 4, said spacer 4 consisting at least partially out of an elastic, temperature-resistant, thermoset material. An elastic material in the area of mutual contact will provide a plug-in connection, which will securely seal off adjacent volumes and ensure a minimum sealing and connecting force depending on the elasticity of the material. Especially preferable is the mounting of such a connection by curing in assembled state: By heating the spacer 4 and its thermosetting material from outside, the metallic parts of the spacer 4 expand together with the casings 2 and 3. As the thermosetting material is not yet in a cured state, it will flow semi-plastically to contact all surfaces—most advantageously including surfaces of the barrel and the casings 2 and 3—before being cured. The thermoset material is then in mutual contact with heated elements of the barrel jacket and will be compressed elastically, as the casings 2, 3 and the spacer 4 cool down. This is especially advantageous, as it ensures additional connection-pressure in case of heat-up of the barrel, as the thermal expansion of the barrel will elastically broaden the thermoset material into the opposite direction, resulting in a barrel-jacket, which will elastically raise the connection-pressure during use. At the same time curing by external heating ensures a minimum connection-pressure even if casings 2 and 3 and spacer 4 get exceptionally hot during elongated use.

Figure 3A:
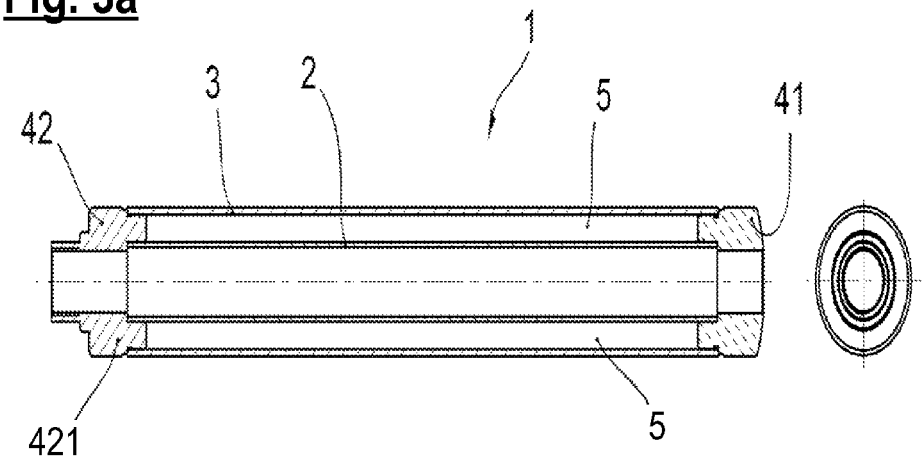
Figure 3B:
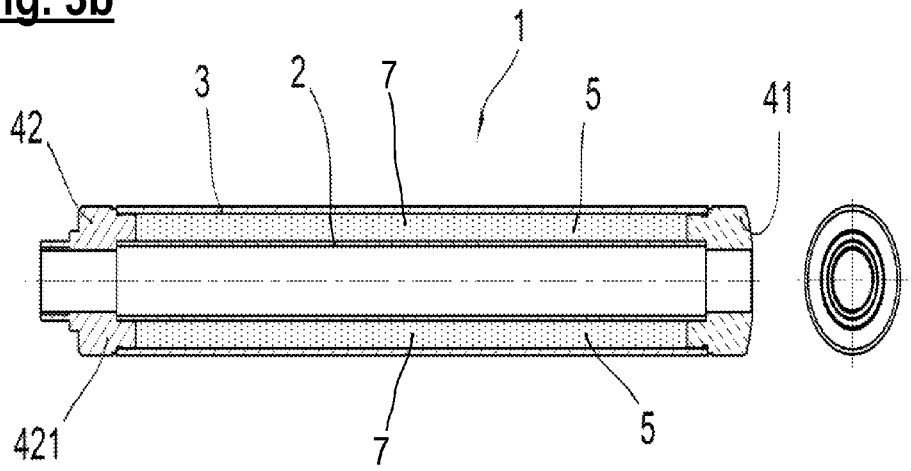

Advantageously a barrel jacket according to the present invention has the continuous gap (5) filled with a substance, for instance, as represented by reference numeral 7 in FIG. 3*b*, of increased density, high thermal capacity and low thermal conductivity. Increased density comprising preferably a density up to 2 grams per cubic centimeter preferably in the area of 0.8 to 1.1 grams per cubic centimeter; high thermal capacity comprising a thermal capacity at constant pressure of at least 1 Joule per gram and Kelvin, preferably in the range of 0.7 to 1.9 Joule per gram and Kelvin; low thermal conductivity comprising a thermal conductivity lower than 0.5 Watt per Kelvin meter, preferably in the range of 0.01 to 0.4 Watt per Kelvin and meter. Materials having the predescribed combination of comprised properties are preferably arranged with a preferable minimum thickness of the continuous gap of 3.5+−0.5 mm.

Advantageously a barrel jacket according to the present invention has within its continuous gap 5 a recoil-compensating means, for instance, as represented by reference numeral 7 in FIG. 3*b*. Preferably said recoil-compensating means 7 comprise an oil, especially preferably a silicon oil of increased viscosity, most preferably a silicon oil of increased viscosity with spring-mounted, perforated, heavy ring-disks arranged within said oil; the ring-disks will be moved elastically within the oil by recoil, overpowering the relatively weak spring-tension and transmitting recoil into turbulent currents within said oil, thus dampening the recoil considerably; afterwards the elastic springs will shift said ring-disks back into their initial position.

In a specially advantageous embodiment the recoil compensating means comprise a silicon oil of increased density, high thermal capacity and low thermal conductivity, thus improving at the same time the thermal properties of the barrel jacket.

The described advantageous features and advantages of the embodiments are not to be seen as restrictive combinations. Advantageous features may be incorporated in any combination within the scope of the independent claim, without deviating from the present invention. Thus all of the advantageous features disclosed in this specification may be combined in any combination. Each feature disclosed in this specification may be replaced by an alternative feature serving the same, equivalent, or similar purpose. Thus each feature disclosed is only an example of a generic series of equivalent or similar features. Without departing from the spirit and scope of the present invention an expert within the field of firearms can make various changes and modifications of the invention to adapt it to various usages and conditions. Thus embodiments of differing combinations are also within the scope of the claims.

SHORT DESCRIPTION OF FIGURES

The figures illustrate schematically . . . .

FIG. 1 *a* barrel jacket 1 according to the present invention, having an inner casing 2, an outer casing 3, a spacer 4 and a continuous gap 5

Figure 2:
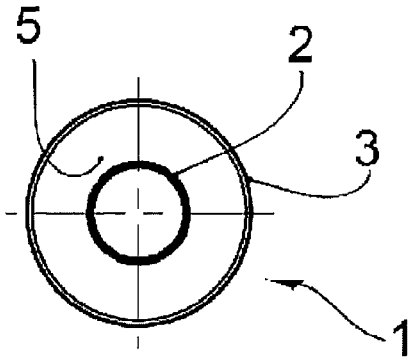

FIG. 2 an advantageous concentric arrangement of inner casing 2 and outer casing 3

FIGS. 3*a* and 3*b* advantageous embodiments, having a nozzle terminating cap 41, a rear-terminating cap 42 and an attachment means 421

Figure 4A:
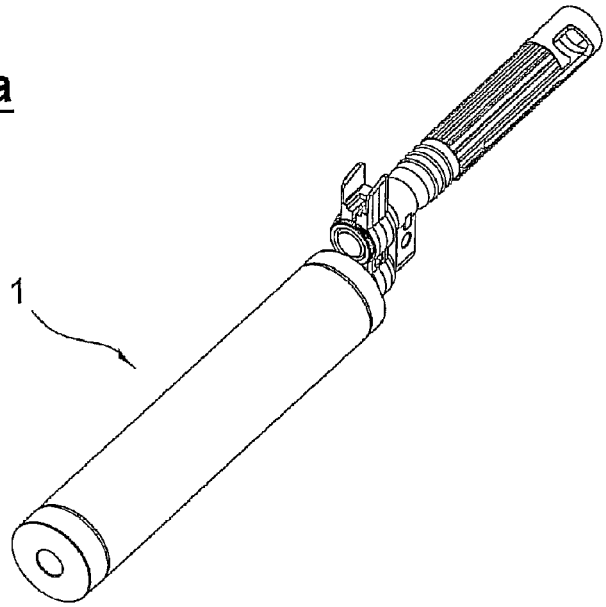
Figure 4B:
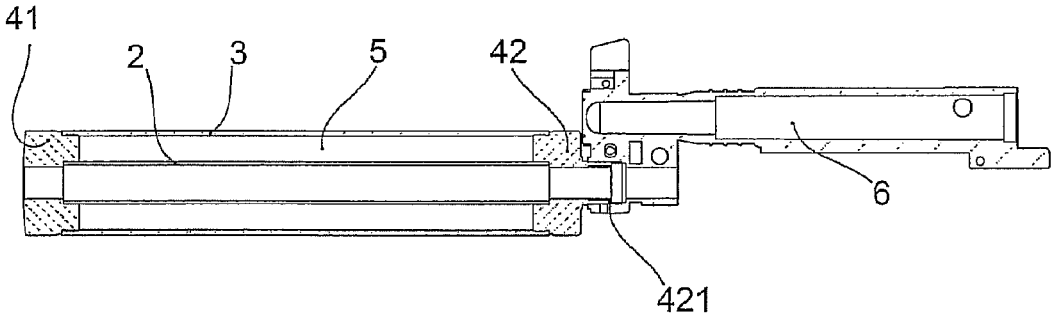

FIGS. 4*a* and 4*b* an advantageous embodiment of a barrel jacket in preferable attachment to a cocking tube guide 6

DETAILED DESCRIPTION OF THE ILLUSTRATIVE EMBODIMENTS

FIG. 1 illustrates in a schematic sketch an inventive barrel jacket 1 in a cut view, showing one end of said barrel jacket 1. The end of the barrel jacket 1 is shown in a cut view along its length. An inner casing 2 and an outer casing 3 embrace a continuous gap 5. The thickness of the continuous gap 5 is constant along the whole depicted length and inner casing 2 and outer casing 3—having equal or differing length and parallel arrangement—are likewise arranged at constant distance to the axis of the barrel jacket 1. The non-depicted barrel would be slipped into said barrel jacket with congruently oriented barrel-axis. The spacer 4 is shaped as a terminating cap, which extends partially into the continuous gap 5, closing it and being fixed in position by elastical deformation of the casings 2 and 3, resulting in a circumferential clamping force, which keeps the terminating cap in place; said fixing may also be carried out by threaded ends, additional screws or other applicable measures. The inner diameter of the central, terminating opening of the spacer 4 is smaller than the inner diameter of the inner casing 2, wherein the terminating cap has a continuous ring-surface, which will contact the slipped-in barrel (not depicted) in a slidably movable manner or in a close-up position, leaving a close-up gap. Thus the illustrated embodiment ensures a close-up position between slipped-in barrel (not depicted) and closely arranged, inner casing 2, said close-up gap having preferably a thickness matching the maximum thermal expansion of the barrel, and said terminating cap being constructed from an elastic material, which preferably maintains a firm, circumferential attachment- and sealing-force along the barrel surface while elastically following thermal expansions of the slipped-in barrel (not depicted).

FIG. 2 illustrates in a cut view an advantageous, concentric arrangement of inner casing 2, outer casing 3, wherein inner casing 2 and outer casing 3 have an advantageous tube-like shape. Such casings, having continuous and straight walls extending above and below the paper plane, provide two parallel, concentric tubes, that may be twisted along their mutual, longitudinal axis without any change of shape or volume of the enclosed continuous gap 5. In combination with a likewise tube-shaped, concentrically arranged barrel (not depicted), a barrel jacket 1 is obtained, which is advantageously simple to mount on the barrel of a firearm, as no mismatch of position is possible any longer: Twisting of the barrel jacket 1 along its longitudinal axis will not change the spatial arrangement.

FIGS. 3*a* and 3*b*, respectively, illustrate in two cut views the sequence of advantageously concentrically arranged materials and components of an advantageous embodiment of a barrel jacket 1, having a nozzle terminating cap 41 and a rear-terminating cap 42 with an attachment means 421, both terminating caps shaped as to function simultaneously as a spacer 4. The inner casing 2 and outer casing 3 are of straight, tube-like shape, have equal or differing length and are arranged in concentric, parallel position. The continuous gap 5 has a ring-shape in the cross-cut view and is characterised by a constant, continuous thickness in the length-cut view. The matchingly ring-shaped nozzle terminating cap 41 has an outer and a concentric inner diameter and is attached to the casings 2, 3 in concentric position. The nozzle terminating cap reaches partially into the continuous gap 5, providing likewise to FIG. 1 a circumferential ring-surface to interact with the non-depicted barrel in mounted position. A rear-terminating cap 42 seals off the continuous gap at the opposite side of the barrel jacket 1 in a similar manner. In contrast to the slightly convex outer surface of the nozzle terminating cap 41, the rear terminating cap 42 has a longitudinally protruding collar, which enlarges the ring-shaped surface, that will engage a slipped-in barrel in mounted position. The protruding collar will advantageously be situated form-fittingly in the main frame of the firearm in a mounted position, providing a secure and improved attachment to the main frame. FIG. 3*b* also shows a substance 7 or a recoil-compensating means 7 arranged in the continuous gap 5.

The cross-cut view illustrates the sequence of concentrically arranged components and respective layers/surfaces, starting at the outside and proceeding towards their mutual centre: wall of the outer casing 3, continuous gap 5 having ring-shape, wall of the inner casing 2, congruently arranged ring-shaped surfaces of terminating caps 41 and 42.

Fastening of the barrel jacket 1 via said rear terminating cap 42 is advantageously carried out via attachment means 421, fastening the barrel jacket 1 directly to the main frame. Thus forces affecting the barrel jacket 1 are mainly absorbed by the main frame, preventing a direct damage or warp of the slipped-in barrel and improving the weapon's usability. Preferably said attachment comprises lateral, form fitting stabilisation, especially advantageous in combination with attachment means comprising threaded ends. The threaded ends allow the attachment to be carried out with additional torque, while a protruding collar will provide mutual surfaces at right angles to said threaded end, providing a secure, elastic, force-fitting attachment with improved stabilisation.

FIGS. 4*a* and 4*b* illustrate in isometric view as well as in length-cut view an advantageous embodiment of a barrel jacket in its attached position, the attachment carried out via a cocking tube guide 6. The cocking tube guide guides a non-depicted tube, said tube allowing interaction with the cocking mechanism via a sideways protruding handle. The cut-out section along the side of the cocking tube guide 6 depicts the general movement of said handle, when shifting the cocking tube within said guide in order to cock the firearm. In isometric view a barrel jacket 1 of tube-like shape is depicted, which has equally tube-shaped terminating caps, said barrel jacket 1 being attached to the cocking tube guide 6, wherein said cocking tube guide 6 will be positioned above the barrel of the firearm; following this spatial arrangement, the cocking tube guide has levelling-means arranged along the axis of sight of the weapon's operator. Furthermore the cylindrical barrel jacket 1 is positioned parallel to the longitudinal axis of the cocking tube guide 6, providing a position concentric and parallel to the barrel (not depicted) of the firearm. The cut view shows this embodiment to consist of concentrically arranged casings and terminating caps, providing a continuous gap 5 as well as an elastically arranged inner casing in close-up position to the non-depicted barrel, said barrel being kept at close-up arrangement via the slidably engaging, circumferential ring-surfaces of the terminating caps. In this embodiment the rear-terminating cap 42 has a protruding collar, improving the secure attachment of the barrel jacket 1 to the cocking tube guide 6 and the main frame (not depicted) via attachment means 421, which are preferably provided in combination with a threaded end. The cocking tube guide is securely attached to the main frame of the firearm, providing the advantageous stabilisation.

SUMMARY

The present invention provides an improved barrel jacket of a firearm, wherein said barrel jacket (1) covers at least partially the outer surface of the bullet-guiding barrel of said firearm, has at least one inner casing (2) and one outer casing (3) and a spacer (4), wherein furthermore the inner casing (2) is arranged adjacent to the barrel, covering said barrel in a close-up position, the outer casing (3) is arranged at a distance to the inner casing (2), covering said inner casing (2), thus providing a continuous gap (5) and said continuous gap (5) being stabilised by at least one spacer (4), said spacer (4) stabilising inner casing (2) and outer casing (3) in their relative positions.

Thus a barrel jacket is provided, which is easy to assemble, improves the usability and durability of the weapon and allows at the same time the use of common and economic materials.

INDUSTRIAL APPLICABILITY

Improved quality at reduced cost make the present invention especially attractive, when looking at industrial, serial production: By providing a design, that allows more economic and less precisely controlled materials to be used, while also improving usability and durability, a barrel jacket is presented, which allows simplified, cost-effective automatic production while providing a better product, that will improve life-time and performance of the related firearm.

REFERENCE NUMBERS

1 barrel jacket
2 inner casing, preferably tube
3 outer casing, preferably tube
4 spacer, preferably terminating cap
41 advantageous nozzle terminating cap
42 advantageous rear-terminating cap
421 attachment-means, preferably comprising thread
5 gap, preferably circumferential gap, especially preferably circular gap
6 cocking tube guide

The invention claimed is:

1. A barrel jacket (1) for a firearm, said barrel jacket (1) being constructed to cover at least partially the outer surface of the bullet-guiding barrel of said firearm, said barrel jacket (1) comprising:

at least one inner casing (2);

an outer casing (3); and at least one spacer (4), wherein, the inner casing (2) is constructed to be arranged adjacent to and cover the barrel;

the outer casing (3) is arranged at a distance to the inner casing (2), covering said inner casing (2), wherein a continuous gap (5) is formed between the inner casing (2) and the outer casing (3), and wherein the outer casing (3) comprises a continuous, hollow body, enclosing the inner casing (2) completely along an outer surface of the inner casing (2); and said continuous gap (5) is stabilised by the at least one spacer (4), wherein said at least one spacer (4) stabilizes the inner casing (2) and outer casing (3) in their relative positions;

wherein said at least one spacer is shaped as a terminating means, and wherein a volume of the continuous gap is confined by the inner casing (2), the outer casing (3), and the at least one spacer to seal the continuous gap against dust.

2. The barrel jacket according to claim 1, wherein the inner casing (2) and outer casing (3) have a concentrical arrangement.

3. The barrel jacket according to claim 1, wherein said at least one spacer (4) is a nozzle terminating cap (41).

4. The barrel jacket according to claim 1, wherein said at least one spacer (4) is a rear-terminating cap (42).

5. The barrel jacket according to claim 1, wherein said barrel jacket (1) is attachable to a firearm via a cocking tube guide (6) or a respective weapon part.

6. The barrel jacket according to claim 1, wherein said at least one spacer (4) has an inner diameter and an outer diameter, the inner diameter being smaller than the outer diameter of the inner casing (2), and wherein the at least one said spacer (4) has a continuous ring surface, wherein said ring surface is to be arranged in a slideable support position along the barrel of the firearm.

7. The barrel jacket according to claim 1, wherein said at least one spacer (4) consists at least partially of an elastic, temperature-resistant, thermoset material.

8. The barrel jacket according to claim 1, wherein said continuous gap (5) is filled with a substance (7) of increased density, high thermal capacity and low thermal conductivity.

9. The barrel jacket according to claim 1, wherein within the continuous gap (5) a recoil-compensating means (7) is arranged.

10. The barrel jacket according to claim 9, wherein the recoil-compensating means (7) comprises a fluid selected from a group consisting essentially of an oil and a silicon oil.

11. The barrel jacket according to claim 1, wherein the inner casing (2) is constructed to be arranged to cover the barrel in a relatively close proximity to the barrel, wherein the relatively close proximity is a position that enables the barrel to thermally expand without detrimental strain from the inner casing (2).

* * * * *